US007033117B2

(12) United States Patent
Ludwig et al.

(10) Patent No.: US 7,033,117 B2
(45) Date of Patent: Apr. 25, 2006

(54) ROCK ANCHOR

(75) Inventors: Wolfgang Ludwig, Klosterlechfeld (DE); Erich Leibhard, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/902,727

(22) Filed: Jul. 29, 2004

(65) Prior Publication Data

US 2005/0025578 A1 Feb. 3, 2005

(30) Foreign Application Priority Data

Aug. 1, 2003 (DE) ..... 103 36 040

(51) Int. Cl.
*E21D 21/00* (2006.01)

(52) U.S. Cl. ..... 405/259.5; 411/397

(58) Field of Classification Search ..... 405/258.1, 405/259.1, 259.2, 259.3, 259.4, 259.5, 259.6; 411/930, 82, 82.1, 82.2, 82.3, 178, 383, 384, 411/397

See application file for complete search history.

(56) References Cited

U.S. PATENT DOCUMENTS

| | | | | |
|---|---|---|---|---|
| 4,157,677 | A * | 6/1979 | Deutschenbaur et al. | 411/548 |
| 4,636,115 | A * | 1/1987 | Davis et al. | 405/259.4 |
| 4,984,937 | A | 1/1991 | Karpellus | |

FOREIGN PATENT DOCUMENTS

| | | |
|---|---|---|
| DE | 3610880 | 7/1993 |
| DE | 9535024 | 3/1996 |
| DE | 9607988 | 9/1997 |
| DE | 0148683 | 10/2002 |
| EP | 1077305 | 2/2001 |
| GB | 2030486 | 4/1980 |
| WO | 0111193 | 2/2001 |
| WO | 3008763 | 1/2003 |

* cited by examiner

*Primary Examiner*—Sunil Singh
(74) *Attorney, Agent, or Firm*—Abelman, Frayne & Schwab

(57) ABSTRACT

A self-drilling rock anchor includes an anchor tube (2), a drill head (6) provided at the first end (5), an outer thread (8) provided at least in a region of the second, free end (7) of the anchor tube and an adapter (11) releasably connectable with the anchor tube (2) and having an inner thread (17) for engaging the outer thread (8) of the anchor tube (2), a screw stop (14), and a quick-intervention element (15) connectable with a rotatable chuck of a drilling tool the rock anchor is driven-in with.

9 Claims, 4 Drawing Sheets

ROCK ANCHOR

BACKGROUND OF THE INVENTION

1. Field of the Invention

The present invention relates to a self-drilling rock anchor for use in mine and tunnel constructions, and in particular to a self-drilling chemical connection anchor. The rock anchor includes an anchor tube provided with a drill head at its first end. At its second, free end, the anchor tube is provided with a profile. On the second, free end, the rock anchor is provided with a releasably connectable therewith adapter having engagement or intervention means that cooperate with a rotatable chuck of a usable drilling tool.

2. Description of the Prior Art

Self-drilling rock anchors, in particular chemical connection anchors and suitable drilling tools with rotatable chucks, and their use in mine and tunnel constructions are well known since long ago. The rock anchors serve primarily for stabilizing walls and hollow spaces in mines, tunnels, galleries, and the like. When hollow spaces are formed, mechanical properties and, in particular, the bearing capacity of stratum is reduced. These stratum are anchored to lying further, undamaged stratum with rock anchors, e.g., chemical connection anchors, and are, thus, secured thereto.

The anchor tube of a rock anchor functions, on one hand, as a drill rod and, on the other hand, when formed as a chemical connection anchor, as a receptacle for a to-be-pressed out mass. A drill head is provided at a first, facing in the setting direction, end of the anchor tube. The second end of the anchor tube is inserted into a chuck of a usable drilling tool with which the anchor tube is set into a constructional component.

Austrian Patent AT-396 390 B discloses a self-drilling rock anchor which is connected to the drilling tool with a coupling sleeve. The drawback of this solution consists in that the free end of the rock anchor needs to be adapted to the shape of the receptacle in the coupling sleeve.

German Publication DE 3610 880 A1 discloses a drill rod that has a sleeve-shaped receptacle with an inner thread for a further drill rod. The further drill rod has a section with an outer thread engageable with the inner thread of the sleeve-shaped receptacle. The drawback of this solution consists in that with the use of this connection technology, the chuck of a drilling tool should be screwed off the drilling rod set in the constructional component with a special tool after the drilling process ended.

Accordingly, an object of the present invention is to provide a self-drilling rock anchor that can be easily set in and which would provide for rapid mounting of the rock anchor in and dismounting of a usable drilling tool.

Another object of the present invention is to provide a rock anchor that can be cost-effectively produced.

SUMMARY OF THE INVENTION

These and other objects of the present invention, which will become apparent hereinafter, are achieved by providing a rock anchor in which the second, free end of the anchor tube is formed with an outer thread, and the adapter is provided with an inner thread for engaging the outer thread in the region of the second end of the anchor tube, and includes a screw stop and a quick-intervention element connectable with a rotatable chuck of a drilling tool the rock anchor is driven-in with.

The adapter is screwed on the second, free end of the anchor tube, and then the rock anchor is inserted into the chuck of the drilling tool with the quick-intervention element of the adapter. At the beginning of the drilling process, the adapter should not be completely screwed on the free end of the anchor tube until the screw stop engages the second end of the anchor tube. During operation of the drilling tool, the adapter rotates until the screw stop engages the second end of the anchor tube, and then the anchor tube is rotated with the drilling tool until a predetermined bore depth is reached.

The anchor tube can be provided as piece goods that is cut to a necessary or desired length either before being delivered to the site or on site. The drill head can be pinned on the first end of the anchor tube also either before it is delivered to the site or on site. In order to improve the extraction properties of rock anchors, the anchor tubes are often provided on their outer side, over its entire length with an appropriate profile. The inner thread of the adapter is adapted to the outer thread provided on the anchor tube. When anchor tube has no outer thread on its outer side, a suitable thread can be cut on the free end of the anchor tube on site for connecting the anchor tube with its adapter. Rather loose tolerances can be provided between the inner thread of the adapter and the outer thread of the anchor tube, without limiting the function of the connection of these two parts. As a result, with an anchor tube cut to a size, removal of burrs on the cut surfaces is not necessary.

Preferably, the quick-intervention element is arranged on an outer side of the adapter. The rotatable chuck of the usable drilling tool is pushed over the adapter for transmitting a torque from the tool to the rock anchor.

Advantageously, a connection sleeve section is provided between the quick-intervention element and the screw stop. Preferably, the connection sleeve section has, at least regionwise, an inner thread engageable with the outer thread on a second, free end of the anchor tube. With the provision of the inner thread in the connection sleeve section, the number of engaging into each other thread turns is increased, which enables transmission of a higher load by this connection.

Advantageously, the screw stop is formed by a bottom section provided at an end of the adapter remote form the quick-intervention element and which has a preferably central opening. The bottom section of the region thereof around the opening forms the screw top.

When the rock anchor is formed as a chemical connection anchor, the bottom section can serve as a restraint section for the to-be-pressed-out mass provided in the anchor. The to-be-pressed-out mass can be stored, e.g., in a film bag and be located in a receptacle, e.g., inner tube located in the anchor. During overhead use, the to-be-pressed-out mass can slide out of the anchor. However, this is prevented by the region of the bottom section around the opening. The preferably central opening provides for displacement therethrough of a press-out mechanism for extracting of the to-be-pressed-out mass, without a need to remove the adapter form the free end of the anchor tube to effect this process.

Advantageously, the quick-intervention means has a key coupling. As a key coupling a bihexagon or a polygon is used, which permits to keep the rotational angle necessary to connect the chuck of the drilling tool with the anchor tube very small. In addition, if necessary, the key coupling can be provided with a tool secured thereto to screw the adapter on or off the anchor tube.

Preferably, the connection sleeve section has, at least regionwise, an outer thread for attachment of fastening means. Because the adapter remains, after the rock anchor has been set in, on the anchor tube, the adapter can be used, e.g., for securing a mat on the wall of a hollow space for stabilization of which the rock anchor is used. Such mats, e.g., are formed of a reinforcing net or of a mesh material of steel or plastics and serve to protect the wall from falling stone pieces. These mats preferably are placed in the regions of the rock anchors in an overlapped condition. With a fastening element, in a first step, a first mat can be fixed with the adapter. Then, a second mat is placed over the adapter and is fixed with the fastening element. In distinction from conventional anchors, anchors with an outer thread on their free end permit to reduce the height of the connection means for securing the attached mats, as the attachment mats are not any more arranged on the anchor tube.

Advantageously, the connection sleeve section has openings or breaks-through which form break-off locations in the adapter. Preferably, there are provided at least two diametrically opposite openings that form break-off locations in the connection sleeve section. Their circumferential length over the connection sleeve section is determined by the minimal size of the web that transmits the torque to the rock anchor which is necessary for drilling the bore in which the anchor is to be set. The web is sheared off only after a predetermined preload is reached.

This embodiment of the adapter is particularly used with to-be preloaded rock anchors. After a predetermined bore depth has been reached, a quick-hardenable mass is squeezed out in the region of the bore bottom from the anchor or is brought into the bore from outside. As soon a predetermined degree of hardness of the mass is reached, the rock anchor is preloaded. After a predetermined preload is reached, the webs shear off, dividing the adapter into two parts. The first part, adjacent to the free end of the anchor tube, remains after shearing-off on the free end of the anchor tube, preventing rotation which can result from displaceable backward, as a result of shocks, of the second part of the adapter. When the adapter has a bottom section, it prevents, after shearing off of the webs, e.g., in a chemical connection anchor, sliding out of a package of a to-be-squeezed mass arranged in the anchor tube, e.g., of the inner tube in which the package is located.

Advantageously, the adapter is produced by a casting process. A subsequent treatment of a cast adapter can be dispensed with if the tolerances are adequate. In addition to this cost-effective process, the adapter can be produced by a casting/milling process.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
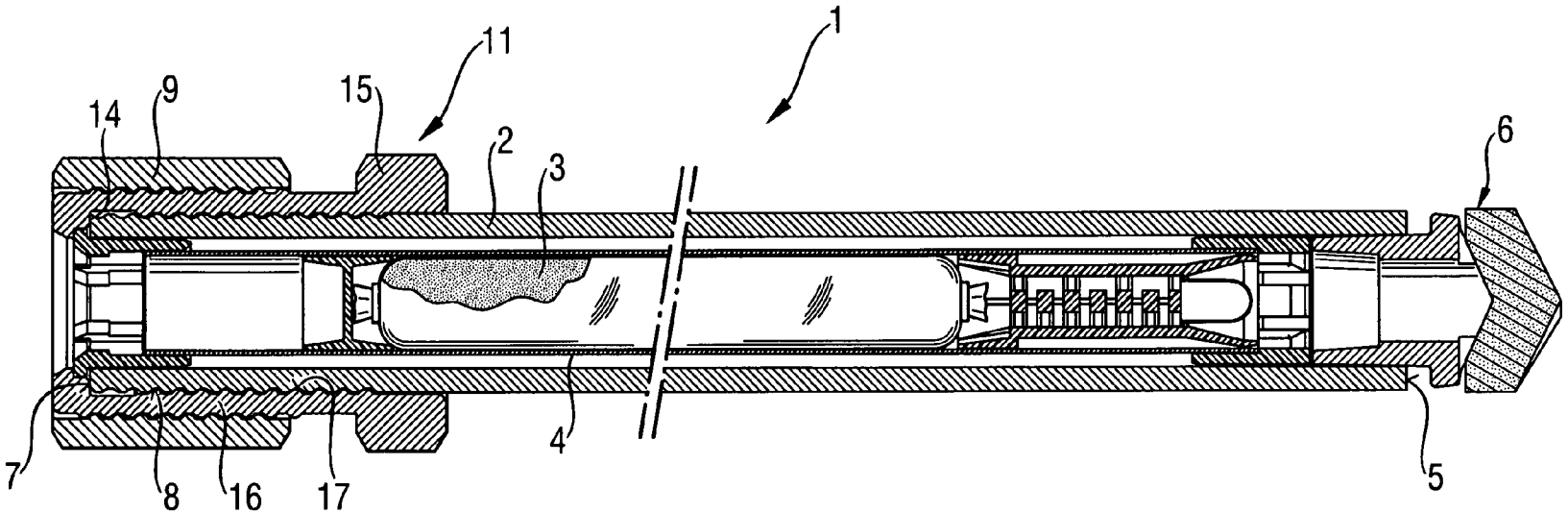
FIG. 1 a longitudinal cross-sectional view of a self-drilling chemical rock anchor according to the present invention with an adapter.

A rock or connection anchor 1 according to the present invention, a longitudinal cross-sectional view of which is shown in FIG. 1, is formed as a self-drilling, chemical connection anchor provided with an adapter. The anchor 1 includes an anchor tube 2 and an inner tube 4 for receiving a press-out mass 3 and arranged within the anchor tube 2. At a first end 5 of the anchor tube 2, a drilling head 6 is mounted. At its second, free end 7, the anchor tube 2 is provided with an outer thread 8. An adapter 11 is screwed on the outer thread 8. As attachment means 9, e.g., for securing a safety mat on the connection anchor, a nut is screwed onto the adapter 11.

Figure 2:
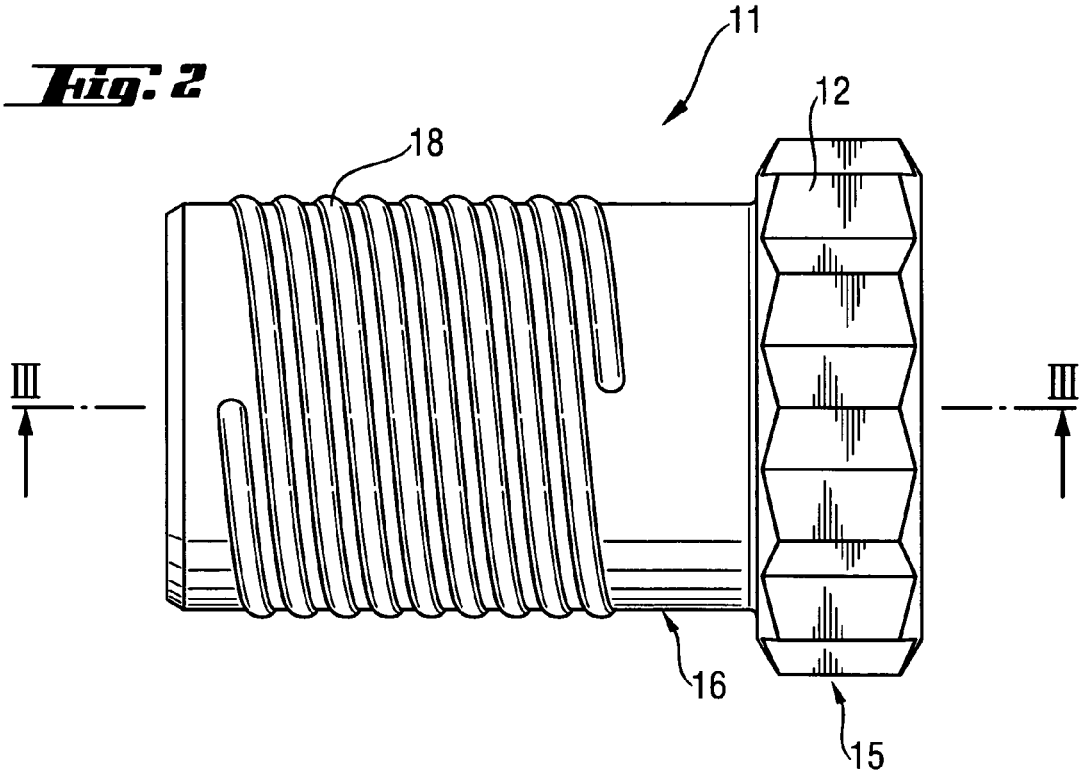
FIG. 2 a side view of the adapter shown in FIG. 1.
Figure 3:
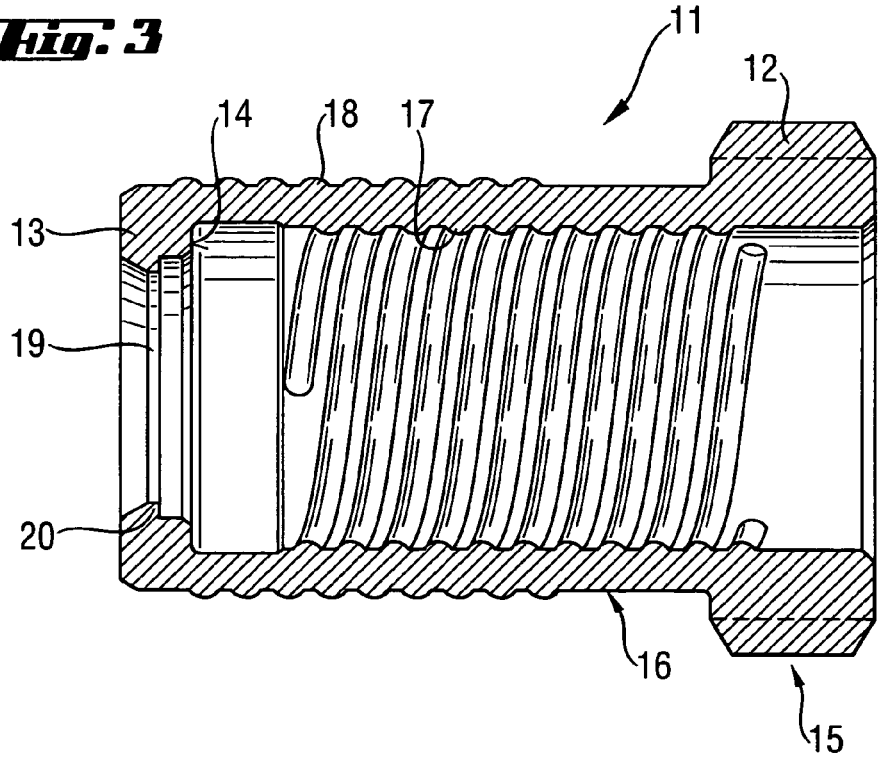
FIG. 3 a longitudinal cross-sectional view of the adapter along line III—III in FIG. 2.

FIGS. 2–3 show, respectively, side and longitudinal cross-sectional views of a first embodiment of the adapter 11. The adapter 11 includes a polygonal key coupling 12 that serves as a quick-intervention element 15 for a rotatable chuck of a to-be-used drilling tool. A bottom section 13 forms a screw stop 14 on the adapter 11. Between the quick-intervention element 15 and the screw stop 14, the adapter 11 has a connection sleeve section 16. The connection sleeve section 16 has, on one hand, an inner thread 17 engageable with an outer thread 8 at the free end 7 of the anchor tube 2 and, on the other hand, it has an outer thread 18 onto which the attachment means 9 is screwed on.

In the bottom section 13, there is provided a central opening 19 through which a squeezing-out mechanism for pressing-out the to-be-pressed-out mass 3 is displaceable. An annular section 20 prevents the inner tube 4 from sliding out or the mass 3 from being squeezed-out of the anchor tube 2, in particular, at overhead use of the rock or connection anchor 1.

Figure 4:
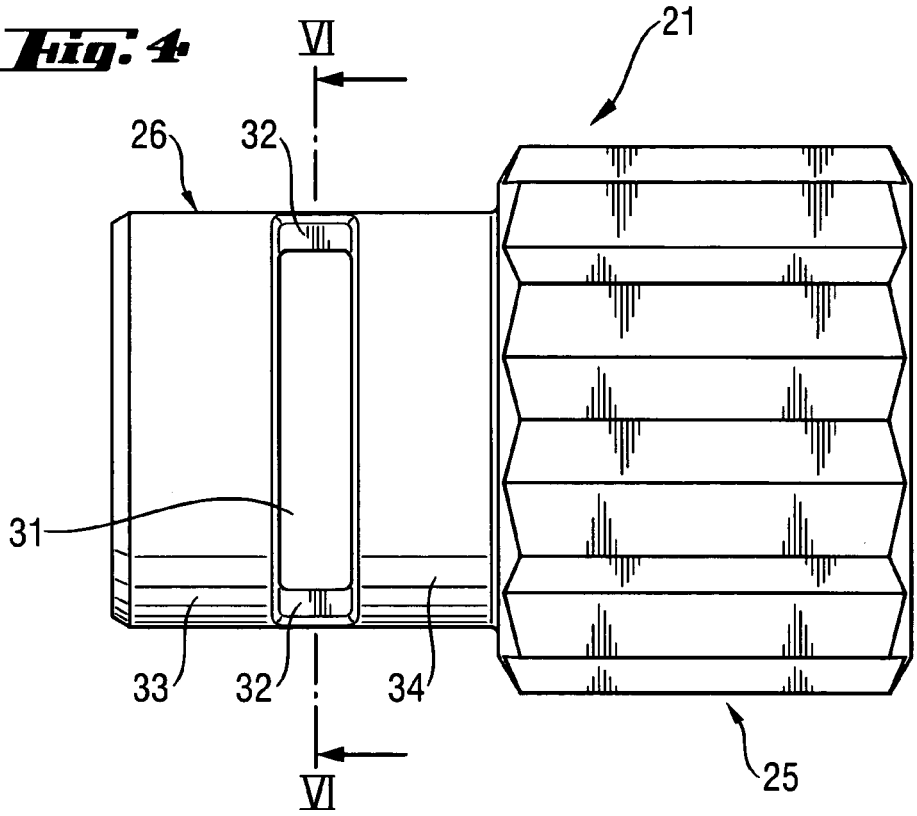
FIG. 4 a side view of another embodiment of an adapter viewed in direction shown with arrow IV—IV in FIG. 6.
Figure 5:
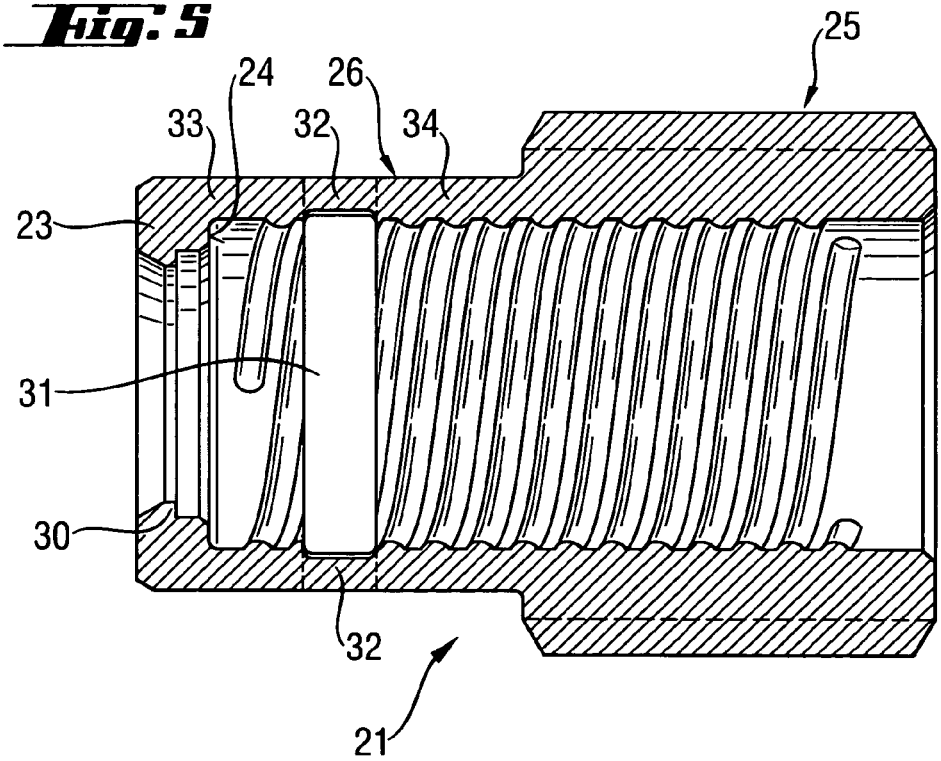
FIG. 5 a longitudinal cross-sectional view of the another embodiment of the adapter shown in FIG. 6 along the line V—V in FIG. 6.
Figure 6:
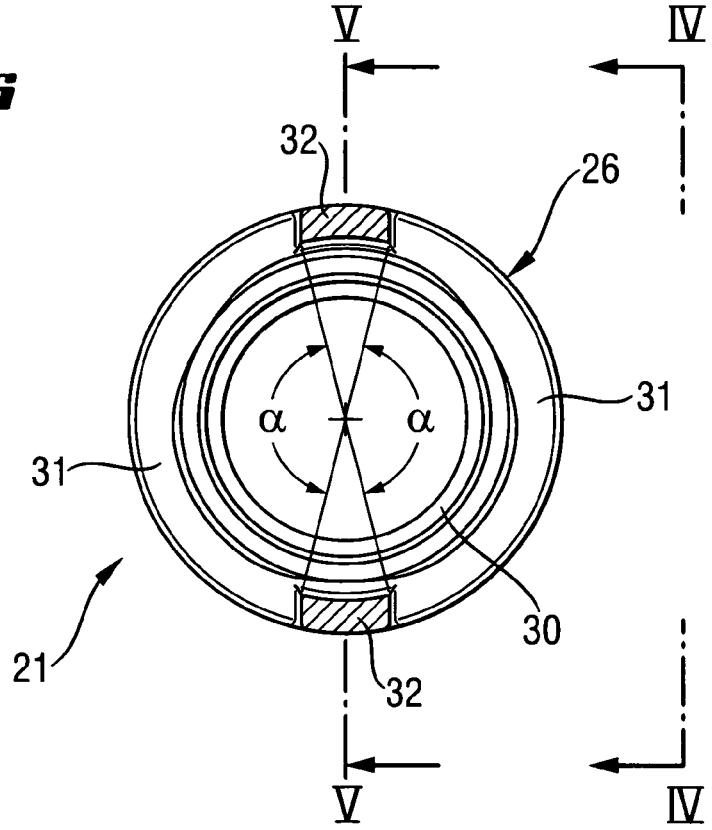
FIG. 6 a cross-sectional view of the adapter along line VI—VI in FIG. 4.

Side, longitudinal cross-sectional, and transverse cross-sectional views of a second embodiment of the adapter 11 are shown in FIGS. 4, 5, and 6. In distinction from the adapter 11, which is shown in FIGS. 2–3, the adapter 21, which is shown in FIGS. 4–6, has an elongate quick-intervention element 25, and the connection sleeve section 26 has no outer thread. Instead, the connection sleeve section 26 has two circumferential openings 31 which form break-off locations for the adapter 21. The openings or breaks-through 31 form an angle $\alpha$. The two webs 32, which remain on the circumference of the connection sleeve section 26 connect first section 33 and a second section 34 of the adapter 21. When a predetermined torque is exceeded, the webs 32 shear off. The first section 33 of the adapter 21 remains on the face end 7 of the anchor tube 2 after the webs 32 have been sheared off. The screw stop 24 or the annular section 30 of the bottom section 23 prevents, even after the second section 34 has been sheared off, sliding out of the inner tube 4 or the to-be-pressed out mass 3 from the anchor tube 2.

Figure 7:
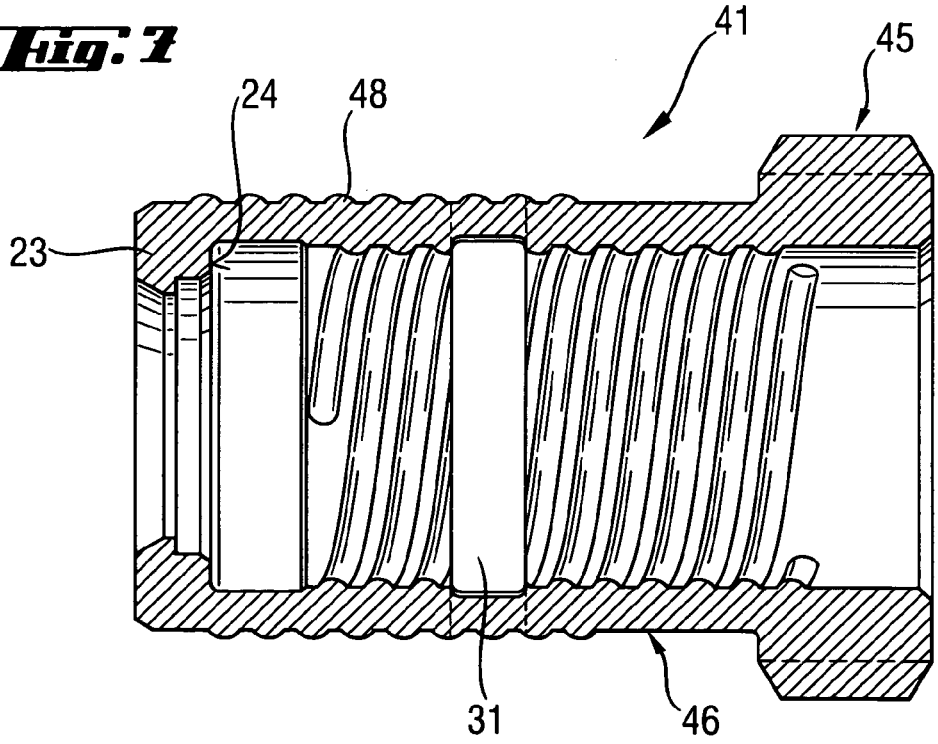
FIG. 7 a longitudinal cross-sectional view similar to that of FIG. 5 of yet another embodiment of an adapter.

FIG. 7 shows a longitudinal cross-sectional view of a modified embodiment of the anchor shown in FIG. 5. In distinction from the adapter 21, the connection sleeve section 46 of the adapter 41 has, in addition, an outer thread 48, and the adapter 41 has a shorter quick-intervention element 45 than the adapter 21.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed:

1. A self-drilling rock anchor for use in mine and tunnel constructions, comprising an anchor tube (2) having opposite first (5) and second (7) ends; a drill head (6) provided at the first end (5); an outer thread (8) provided at least in a region of the second end (7); and an adapter (11; 21; 41) releasably connectable with the anchor tube (2) and having an inner thread (17) for engaging the outer thread (8) in the region of the second end (7) of the anchor tube (2), a screw stop (14; 24), and a quick-intervention element (15; 25; 45) connectable with a rotatable chuck of a drilling tool the rock anchor is driven in with, wherein the quick-intervention element (15; 25; 45) is provided on an outer side of the adapter (11; 21; 41); and wherein the adapter (11; 21; 41) further includes a connection sleeve section (16; 26; 36) provided between the quick-intervention element (15; 25; 45) and the screw stop (14; 24).

2. A rock anchor according to claim 1, wherein the inner thread (17) is provided, at least regionwise, in the connection sleeve section (16; 26; 46).

3. A rock anchor according to claim 1, wherein the screw stop (14; 24) is formed by a bottom section (13; 23) provided at an end of the adapter (11; 21; 41) remote from the quick-intervention element (15; 25; 45).

4. A rock anchor according to claim 3, wherein the bottom section (13; 23) has an opening (19).

5. A rock anchor according to claim 4, wherein the opening (19) is a central opening.

6. A rock anchor according to claim 1, wherein the quick-intervention element comprises a key coupling (12).

7. A rock anchor according to claim 1, wherein the connection sleeve section (16; 46) has, at least regionwise, an outer thread (18) for attachment of fastening means (9).

8. A rock anchor according to claim 1, wherein the connection sleeve section (16; 46) includes openings (31) that from break-off locations on the adapter (21; 41).

9. A rock anchor according to claim 1, wherein the adapter (11; 21; 41) is formed as a cast part.

* * * * *